United States Patent [19]

Diamantides

[11] 4,206,433

[45] Jun. 3, 1980

[54] UNIVERSAL IMPEDANCE POWER APPARATUS

[76] Inventor: Nick D. Diamantides, 2517 Fourteenth St., Cuyahoga Falls, Ohio 44223

[21] Appl. No.: 940,623

[22] Filed: Sep. 8, 1978

[51] Int. Cl.[2] ..... H01F 7/08

[52] U.S. Cl. ..... 335/266; 335/272

[58] Field of Search ..... 335/209, 266, 231, 268, 335/222, 272; 310/36, 38, 67

[56] References Cited

U.S. PATENT DOCUMENTS

| | | | |
|---|---|---|---|
| 1,852,232 | 4/1932 | Buchhold | 335/272 |
| 2,986,683 | 5/1961 | Lavet et al. | 310/36 X |
| 3,299,381 | 1/1967 | Adams | 335/272 X |

*Primary Examiner*—George Harris

[57] ABSTRACT

Subject of the present invention is a compensating means for the mechanical losses and, or spring stresses in a universal impedance apparatus of electric power transmission and distribution use, the apparatus having a field and an armature coupled through a spring, with one or the other functioning as a mechanical oscillator. The means consists of a compensating winding deployed on the armature in tandem with the main winding and carrying an a.c. current in phase with the velocity of the oscillation, or a current additively proportional to both the velocity and the displacement of the oscillation.

1 Claim, 2 Drawing Figures

UNIVERSAL IMPEDANCE POWER APPARATUS

This invention relates to equipments used in the field of transmission, distribution and utilization of electric power and in particular to the area of impedance implementing devices such as reactors, capacitors, regulators, fault-current attenuators, and circuit breakers.

In applicant's patent application Ser. No. 769,311 filed on Feb. 17, 1977, now U.S. Pat. No. 4,163,962 there was disclosed a universal impedance power apparatus whose principle of operation is the forced rotary oscillation of a field magnet, caused by the interaction of its own magnetic field with the alternating magnetic flux of a stationary armature whose winding (heretofore called the main winding) is traversed by the line current, the armature being surrounded by the field magnet. The field magnet is either a permanent magnet, or an electromagnet whose magnetizing coil is fed by continuous current of fixed polarity. The oscillation of the magnet is constrained by a spring, while the armature is held immobile by being rigidly connected to the supporting structure of the apparatus.

The system of universal impedance apparatus described in the aforesaid copending application fulfills the basic requirements of efficiency, simplicity, and long life under operational conditions. However, it has become obvious to the applicant that further improvements, beyond the specific implementation disclosed, can be had, and the apparatus' utility and efficiency increased by incorporating in the armature assembly a compensating means aganist the mechanical losses produced by bearing friction, windage, or other similar causes. A further function of such compensating means will be the creation—through electrical means—of a spring-like torque through which the stresses generated in the mechanical spring can be partially relieved.

Figure 1:
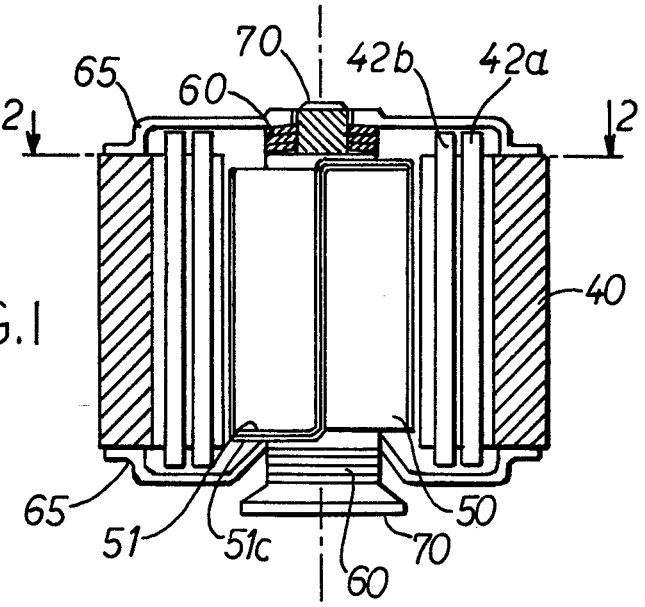

Construction of an improved universal impedance apparatus possessing the aforesaid feature of loss compensation and spring torque enhancement, accordingly, becomes the principal object of this invention, with other objects becoming apparent upon reading of the following specification, considered and interpreted in the light of the accompanying drawing in which FIG. 1 is an elevated view of the multimpeder comprising an electromagnet, an armature, and a spring in an arrangement of cylindrical geometry.

Figure 2:
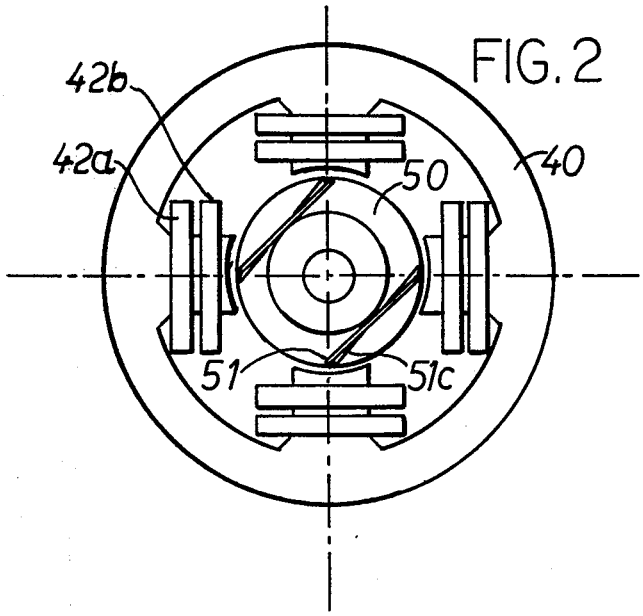

FIG. 2 is a plan view of the multimpeder.

As explained in the aforesaid copending application, the oscillatory motion of the field mass is described by the differential equations:

$$E \sin wt = Li^{(1)} + Ri + Blrq^{(1)}, \quad (1$$

$$T = Blri = Mq^{(2)} + cq^{(1)} + kq. \quad (2)$$

in which the symbols have the following meaning:

E is the line voltage, w is the frequency (60 Hz) of the line voltage,

L is the inductance of armature coil, named main coil or main winding,

R is the resistance of the main winding, i is the current through the main winding, T is the total torque applied to the mass of the field magnet, B is the strength of the magnetic field in the air gap between field and armature, l is the total length of the main winding subjected to the magnetic field B, r is the radius of the cylindrical air gap, M is the polar moment of inertia of the oscillating mass about the axis of oscillation, k is the stiffness of the spring, c is the coefficient of viscous damping of the oscillatory motion, whose coefficient's magnitude may include the value zero, and (1),(2), as superscripts, indicate first and second time-derivatives respectively.

The first of the two equations describes the electrical behavior of the multimpeder, and its terms represent voltage components. The second equation describes the mechanical behavior of the multimpeder, and its terms represent torque components.

The behavior of the multimpeder is described by the solution of the above simultaneous differential equations (1) and (2).

It is commonly known to those familiar with the analysis of oscillatory systems that the displacement, velocity, and acceleration of the oscillatory movement are maximized when the viscous damping term in the second equation $$cq^{(1)} = T_c, \quad (3a)$$

is made as small as possible.

It is one of the subjects of my invention to neutralize this term by implementing an appropriate feedback means, which will augment the total torque T by an amount sufficient to counteract the component $T_c$.

On the other hand, the spring component of the torque $$kq = T_k, \quad (3b)$$

created by the angular displacement q, imposes stresses proportional to $T_k$ within the spring that can be substantial.

It is a second subject of my invention to partially relieve these stresses by means of the same feedback means that neutralize the component $T_c$. For these two purposes a second winding is added to the armature, called compensating winding or compensating coil, the turns of which are placed either in the same armature slots housing the main winding, or in separate slots exclusively designated to the compensating winding.

If a compensating current $i_c$ is made to flow through this winding, and if its turns, subjected to the magnetic field B, are $l_c$ long and at a distance $r_c$ from the oscillation axis, the compensating winding will increase the main torque Blri by an amount $Bl_cr_ci_c$. This changes equation (2) to $$Blri + Bl_cr_ci_c = Mq^{(2)} + cq^{(1)} + kq. \quad (4)$$

The phase and magnitude of the compensating current $i_c$ can be controlled so that it partially negates the effect of the viscous damping term $cq^{(1)}$, and at the same time enhances the effect of the spring term kq. To accomplish the second task, the original mechanical spring, which was to have the stiffness k, is replaced by a weaker mechanical spring having the stiffness $k_e$, $$k_e < k. \quad (5)$$

At the same time the compensating torque component is made equal to $$Bl_c r_c i_c = cq^{(1)} + (k_e - k)q. \quad (6)$$

Substitution of equation (6) into equation (4) changes the latter to $$Blr_i = Mq^{(2)} + kq, \quad (7)$$

which is exactly the relationship describing an effectively lossless oscillation. In addition, while the mechanical spring is now weaker and, therefore, subject to lower stresses for the same angular displacement q, the effective spring remains the same thanks to the electromagnetic torque term $(k_e - k)q$.

If equation (6) is rewritten as $$i_c = \frac{c}{Bl_c r_c} \frac{dq}{dt} + \frac{k_e - k}{Bl_c r_c} q, \quad (8)$$

it defines the necessary value of the compensating current $i_c$ that is to be fed into the compensating armature winding. The same equation indicates that an angular velocity sensor will be necessary to obtain a signal proportional to the velocity dq/dt of the oscillating magnet, and an angular displacement sensor to obtain a signal proportional to the oscillation displacement q. Both these signals will be inputed into a current amplifier which will generate $i_c$ according to equation (8). both sensors and amplifier are state-of-the-art devices.

It can be seen from this analysis that an effective and simple means of compensating for the mechanical losses of the multimpeder is structured. This enables the multimpeder function to approach its theoretical capabilities, and the multimpeder impedance to attain its full range of magnitude theoretically possible. At the same time, the mechanical burden carried by the spring is greatly reduced.

In view of this new feature, the multimpeder, shown schematically in FIGS. 1 and 2, consists of an immobile armature 50 rigidly attached to the apparatus' support 70 and equipped with a main winding 51 and a compensating winding 51*c*. The armature is surrounded by the field magnet 40, which can be two-pole or multipole, and which is either a permanent magnet or an electromagnet. The field electromagnet is energized by base magnetic coils 42*a* and control magnetic coils 42*b*, and is mounted so that it is free to oscillate about the common axis of the field and armature, its oscillation being constrained but not prevented by a torsion spring 60 inserted between the magnet 40 and the support 70. In order not to impair the drawing clarity only one conductor is shown for either the main winding 51 or the compensating winding 51*c*. The magnet 40 is carried by the spring 60 by means of the arms 65. Although the magnet is shown having salient poles, it is obvious for those versed in this art that the magnetic field can be generated equally well by a so-called rotating cylindrical magnet in the manner commonly used in synchronous machines.

While the present description of the multimpeder discloses a specific arrangement of the compensating means, the design is not meant to be so restricted. It will be apparent to those skilled in the art that various other arrangements of the compensating coil may be effected without departing from the spirit of the invention or the scope of the appended claims.

What is claimed is:

1. A multimpeder as described comprising in combination a field magnet mounted in a manner that leaves it free to oscillate about an oscillation axis, an armature surrounded by said field magnet and immovably affixed on rigid supports, said armature being equipped with a main winding and a compensating winding, both said windings being under the influence of the magnetic field generated by said field magnet, and both windings being capable of carrying electric currents, a torsion spring inserted between said field magnet and said rigid supports, said torsion spring constraining but not preventing the free oscillation of said magnet about said oscillation axis.

* * * * *